US010415914B2

(12) United States Patent
Lamparter et al.

(10) Patent No.: US 10,415,914 B2
(45) Date of Patent: Sep. 17, 2019

(54) SHOT COUNTERS AND FIREARMS INCLUDING SHOT COUNTERS

(71) Applicant: HECKLER & KOCH GmbH, Oberndorf (DE)

(72) Inventors: Ingo Lamparter, Reutlingen (DE); Frank Scheuermann, Ennepetal (DE); Michael Schumacher, Fluorn-Winzeln (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 15/858,828

(22) Filed: Dec. 29, 2017

(65) Prior Publication Data

US 2018/0142978 A1 May 24, 2018

Related U.S. Application Data

(63) Continuation of application No. PCT/EP2016/001100, filed on Jun. 29, 2016.

(30) Foreign Application Priority Data

Jun. 29, 2015 (DE) ..... 10 2015 008 382

(51) Int. Cl.
*F41A 19/01* (2006.01)

(52) U.S. Cl.
CPC ..... *F41A 19/01* (2013.01)

(58) Field of Classification Search
CPC ..... F41A 9/62; F41A 9/70; F41A 9/65; F41A 19/01
USPC ..... 42/1.01, 1.02, 1.03
See application file for complete search history.

(56) References Cited

U.S. PATENT DOCUMENTS

| | | | | |
|---|---|---|---|---|
| 4,001,961 | A * | 1/1977 | Johnson | F41A 19/01 324/94 |
| 8,046,946 | B2 | 11/2011 | Packer et al. | |
| 8,109,023 | B2 * | 2/2012 | Pikielny | F41A 19/01 42/1.01 |
| 9,303,937 | B2 * | 4/2016 | Acarreta | F41A 9/62 |
| 9,435,598 | B2 * | 9/2016 | Seckman | F41A 9/62 |

(Continued)

FOREIGN PATENT DOCUMENTS

| | | |
|---|---|---|
| DE | 3911804 | 10/1990 |
| DE | 10148677 | 4/2003 |

(Continued)

OTHER PUBLICATIONS

International Searching Authority, "International Search Report and Written Opinion", issued in connection with PCT Patent Application No. PCT/EP2016/001100, dated Oct. 18, 2016, with English Translation, 20 pages.

(Continued)

*Primary Examiner* — John Cooper
(74) *Attorney, Agent, or Firm* — Hanley, Flight & Zimmerman, LLC

(57) ABSTRACT

The invention relates to a shot counter for a firearm, which comprises a first magnetic pole, a second magnetic pole, and a coil. The first magnetic pole and the second magnetic pole have a polarization opposite to each other. The first magnetic pole and the second magnetic pole are configured to pass in response to a fired shot the coil one after the other along the track and to induce in the coil a voltage.

18 Claims, 7 Drawing Sheets

(56) References Cited

U.S. PATENT DOCUMENTS

| | | | | |
|---|---|---|---|---|
| 2010/0031552 | A1* | 2/2010 | Houde-Walter | F41A 35/00<br>42/72 |
| 2010/0251586 | A1* | 10/2010 | Packer | F41A 19/01<br>42/1.01 |

FOREIGN PATENT DOCUMENTS

| | | | | |
|---|---|---|---|---|
| DE | 102004015465 | | 12/2005 | |
| DE | 102007062646 | B4 * | 12/2007 | F41A 19/01 |
| DE | 102007062646 | | 6/2009 | |
| DE | 102007062647 | | 6/2009 | |
| DE | 102007063680 | | 8/2009 | |
| DE | 102007062648 | | 10/2010 | |
| EP | 0554905 | | 8/1993 | |

OTHER PUBLICATIONS

German Patent Office, "Office Action", issued in connection with German Patent Application No. 10 2015 008 382.1, dated Oct. 26, 2015, with English Translation, 8 pages.

* cited by examiner

SHOT COUNTERS AND FIREARMS INCLUDING SHOT COUNTERS

CROSS-REFERENCE TO RELATED APPLICATIONS

This patent arises from a continuation of International Patent Application PCT/EP2016/001100, filed Jun. 29, 2016, which claims the benefit of German Application DE 10 2015 008 382.1, filed Jun. 29, 2015. International Patent Application PCT/EP2016/001100 and German Application DE 10 2015 008 382.1 are incorporated by reference herein in their entirety.

TECHNICAL FIELD

This disclosure relates to shot counters and firearms including shot counters, as well as methods for shot counting. In some example, a shot counter receives its operating power from an automatic reloading process at the firearm.

BACKGROUND

Shot counters are known in different configurations and have the task of counting the shots fired with a firearm. In this context, counting shots fired with a firearm means that a part arranged in the firearm changes its condition with every shot being fired, so that the condition of this part provides information on the number of shots fired with the firearm.

The number of shots fired with a firearm is important for different functions. For example, there are automatic weapons with a fire burst mode, in which the condition of a counting mechanism continues to change after each shot, for example, a control curve is moved after each shot and, after a predetermined number of shots, an end of the fire burst is caused. The condition, for example, the position of the counting mechanism, provides information on the number of shots fired, so that the condition of the counting mechanism shows a shot count. The shot count on a firearm is an effective method to evaluate wear on a firearm.

Example Objective of the Disclosure

It is one example objective of the present disclosure to provide a battery-free shot counter, which counts fired shots and reliably distinguishes shots from other occurrences on the firearm.

The invention is defined in the independent claims. Further aspects of the invention are shown in the dependent claims, the enclosed drawing, and the subsequent description.

BRIEF DESCRIPTION OF THE FIGURES

Subsequently, examples of the invention are described in more detail with reference to the enclosed, schematic drawings.

In the figures, the same or similar parts are depicted with the same reference signs.

DETAILED DESCRIPTION

Figure 1:
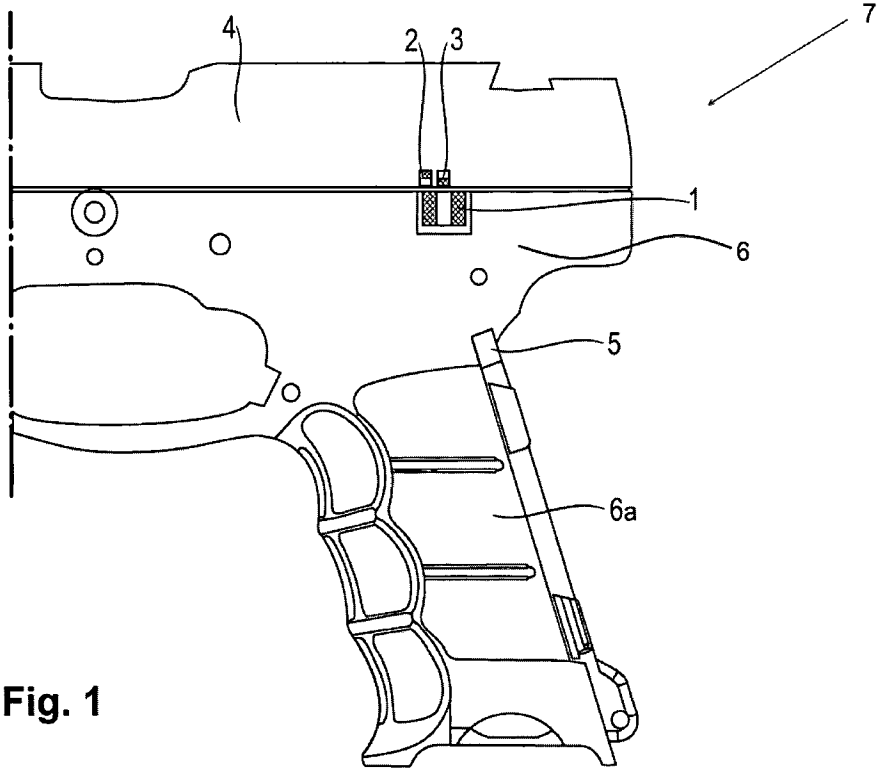
FIG. 1 shows a schematic representation of a pistol, which includes an example shot counter disclosed herein, from the left.

In these documents location designations, such as "above," "below," "forward," "backward," "right," "left," etc. always refer to a firearm kept in normal shooting position, in which the bore axis extends in horizontal manner and the shot is fired forward, away from the shooter.

EP 0 554 905 A1 (Heckler & Koch) describes a device for monitoring the number of movements of at least a movable part of the firearm, wherein means for detecting at least one parameter of the movement are provided, from which the number of fired shots can be determined.

U.S. Pat. No. 4,001,961 (Johnson) describes an electrochemical measuring instrument with a shot counter circuit for a firearm, which has an externally visible display. Maintenance and repair or the replacement of parts triggered by the display should increase the reliability of the firearm. The measuring instrument, which functions depending on power and time, can be activated by firearm usage, as well as by a switch on the trigger, an inductive or piezoelectric transducer, or as part of the circuitry in internally charged firearms.

DE 10 2007 062 646 B4 (Walther) describes an apparatus for producing electric power in a firearm with a lock, which is flexibly mounted in reciprocal manner in relation to a handle piece, wherein in the handle piece in the neighborhood of the lock a first electric element is provided, and in the lock in the neighborhood of the handle piece a second element is provided, which interacts with the first element, in order to produce an electric voltage in the first element when the lock is moved in connection with firing a shot. When firing a shot, the movement of the lock in opposite shot direction generates a first voltage impulse in the first element, and the back movement of the lock in shot direction following a movement of the lock in opposite shot direction generates a second voltage impulse in the first element. As claimed there, compared with the first voltage impulse, the second voltage impulse should have an opposite sign.

DE 101 48 677 A1 (Glock) shows a pistol having a slide, which recoils on the handle piece and receives the barrel when firing a shot against the force of a return spring, which pistol has a device for determining the number of shots. In the handle piece, this device comprises electronics having a microprocessor with memory, a piezoelectric first sensor connected with the microprocessor, which absorbs the recoil impulse occurring with every shot, and emits a corresponding signal to the microprocessor. Said device also has a power supply and outside of the pistol it has a reading device for reading the memory. The microprocessor is connected with a second sensor, which emits a second signal to the microprocessor when the slide is recoiled, wherein the microprocessor emits a counting impulse to the memory at a time interval between the first and second signal, which corresponds to the time interval between firing the shot and recoiling the slide.

DE 39 11 804 A1 (Walther) describes a device for determining the characteristic data of firearms. In the handle or in the barrel of the firearm, a non-deletable IC element with an integrated circuit is arranged, which stores the cumulative number of fired shots, as well as other characteristic data. The firing of the firearm is registered by an acoustic transducer or a pressure sensor and converted into an electric signal, which triggers the counting impulse in the IC element. By means of an external evaluation unit, which can be connected to the firearm, the total number of shots previously fired or other characteristic data of the firearm, for example, serial number, type description, year of construction, etc., can be inquired after a certain operating time.

DE 10 2004 015 465 A1 (Martens) describes a firearm, especially a long or short weapon, which has a registering device that is configured in such a way that it generates on or after firing a shot shot-specific signals for storing on a data carrier, wherein the signals represent shot-specific data, namely at least the fact that a shot was fired.

Figure 7A:
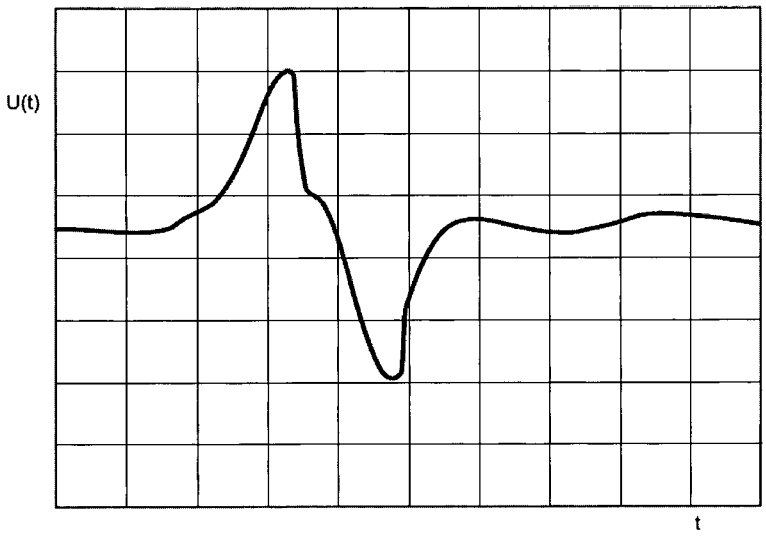
FIG. 7A shows a voltage curve at an induction coil due to movement of the shutter slide when using only one magnet.

FIG. 7 of the present application shows a voltage curve of an induced voltage in an arrangement with a magnet and a coil according to prior art, for example, DE 10 2007 062 646 B4 (Walther), wherein the magnet is arranged, for example, in the shutter slide of a pistol and the coil in its handle piece. In a passage of the magnet, the coil is magnetically polarized, which induces a voltage. The form of the induced voltage is approximately the same in forward and reverse direction, wherein only their amplitudes differ because of different forward and reverse speeds. When the voltage is induced, the voltage curve shows a positive voltage spike at a first half-wave of the voltage curve and a negative voltage spike at a second half-wave of the induced voltage.

Figure 7B:
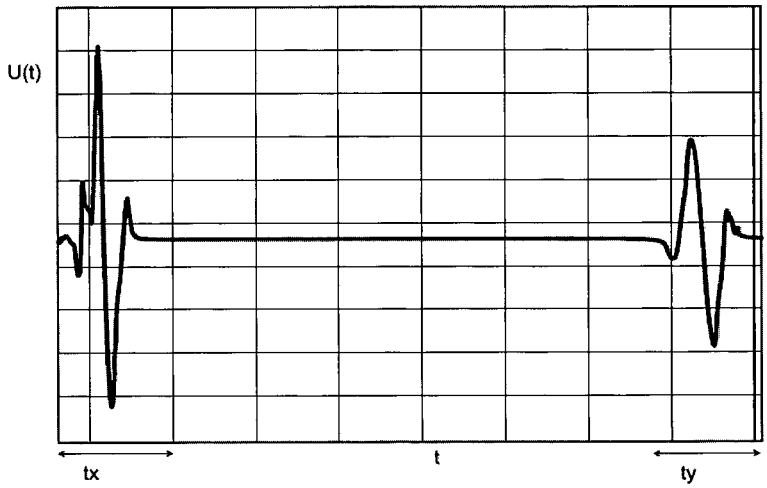
FIG. 7B shows a complete voltage curve at an induction coil due to backward movement of the shutter slide and subsequent forward movement of the shutter slide after a shot has been fired with only one magnet.

FIG. 7B shows at an earlier period of time (tx) a voltage curve in reverse direction and at a later period of time (ty) a voltage curve in forward direction of the shutter slide. Essentially, there is no induced voltage between the earlier period of time (tx) and the later period of time (ty).

For example, the voltage curves shown in reverse and forward direction are triggered by firing. FIG. 7B shows that the voltage curves differ in intensity because of the different travel speeds of the lock in reverse and forward direction. However, in general, the voltage curves they are essentially the same. As a result, it is difficult to make a repeatable, accurate distinction of the voltage curves in reverse and forward direction of the lock slide over many thousands of shots when measuring the different voltage intensities, because the permanent magnetic inductively-generated voltages and their voltage differences are very low and often distorted.

U.S. Pat. No. 8,046,946 B2 describes a shot counter for a firearm, which comprises a permanent magnet mounted on the firearm and a coil mounted on the firearm. A movement of the magnet in relation to the coil induces an electromotive force in the coil. This force can be used to count the shots in a shot counter.

FIG. 1 shows a firearm configured in the form of a self-loading pistol, which has an inventive shot counter. Before providing a more detailed description of the shot counter, general aspects of the invention are described below.

The invention disclosed herein relates to an apparatus for recording a number of shots fired by a firearm. The apparatus comprises a first magnetic pole, a second magnetic pole, and a coil. The first and the second magnetic pole are arranged in such a way that they move in response to a fired shot on a track in relation to the coil, with polarizations opposite to each other, which pass the coil one after the other and induce in the coil an opposite voltage.

Because of the different polarizations of the poles, an induced voltage takes a different course in a shutter return results than in a shutter lead. In particular, the courses differ in the directions of their greatest voltage spikes. The course of an induced voltage corresponds to a voltage signal.

In one example, the firearm involves a self-loading firearm. In this context, a self-loading firearm involves a semi-automatic or fully automatic firearm, especially a pistol, a gun, a machine gun, or a grenade gun.

In one example, the coil comprises a coil core.

In one example, the coil core has at least two parallel prongs, which are arranged in such a way that the first magnetic pole and the second magnetic pole pass the prongs one after the other. Using multiple prongs increases the performance, which can be used for signal evaluation, as well as for operating power supply.

In one example, the first magnetic pole and the second magnetic pole are associated with different magnets or the same magnet.

In one example, the first and the second magnetic pole are arranged at a locking element, and the coil is arranged at the handle piece or at the housing of the firearm. For example, the handle piece is the stationary element of a pistol (short weapon) comprising the handle, while the housing involves the analogous holding element of a gun (long weapon).

In one example, the apparatus comprises a processor, and an electronic circuit is configured to provide the processor at least with a portion of the electric power generated in the coil.

In one example, the processor is configured to identify and count the fired shot when the induced voltage signal level passes a threshold level. In addition, in further examples, the form of the induced voltage signal is also considered, in order to detect a fired shot.

In one example, the processor is configured to use a portion of the induced voltage provided, in order to supply operating power. As a result, the processor does not require any power from other sources, and the firearm does not require any batteries for a shot count.

In one example, the apparatus comprises an antenna, which is configured to emit a signal that corresponds to the number of shots fired by the firearm and identified by the processor.

In one example, the antenna is configured to receive a send command, which causes the processor to emit the signal that corresponds to the number of shots fired by the firearm.

In one example, the first magnetic pole and the second magnetic pole are arranged at a distance to each other, so that, when the first magnetic pole and the second magnetic pole pass the coil core, preferably a soft iron core, in response to a fired shot, an optimum magnetization and re-magnetization takes place and thus power is induced.

The invention also relates to a firearm, which comprises an apparatus according to the invention described above or the corresponding examples.

Furthermore, the invention relates to a method for recording a number of shots fired by a firearm. The method comprises the provision of a first magnetic pole, the provision of a second magnetic pole, its magnetic polarization opposite to the polarization of the first magnetic pole, the provision of a coil in response to a fired shot, the passing of first the second magnetic pole and subsequently the first magnetic pole at the coil, so that an opposite voltage is induced at the coil, the recording of the induced voltage and, based on the form of the induced voltage signal, for example, the amplitude, whereby the firing of a shot is identified to a detection system, as well as the incrementation of a shooting score.

In one example, the first magnetic pole and the second magnetic pole are provided at a lock of the firearm, and the coil is provided at a handle piece or a housing of the firearm.

In a special example, the reverse direction of the lock differs from its forward direction by the form of the induced voltage signal, especially the amplitude, for example, by evaluating the direction of the voltage spike above or below a predetermined upper or lower threshold.

In one example, the reverse direction of the locking element differs from its forward direction by the form of the induced voltage spike, especially the amplitude.

Returning to FIG. 1, the shot counter in the example shown basically comprises a coil 1, an electronic circuit 5, a first magnet 2 and a second magnet 3. The firearm 7 configured in the form of a self-loading pistol comprises a shutter slide (or other locking element) 4 and a handle piece 6, wherein the shutter slide 4 is, in a well-known manner, translationally movable back and forth in relation to the handle piece. In the example shown, the first and the second magnet 2, 3 are arranged in the shutter slide 4, and the coil 1 and the electronic circuit 5 are arranged in the handle piece 6.

At the same time, both magnets 2, 3 and the coil are arranged to each other in such a way that the magnets 2, 3 glide over the coil 1 during backward and forward movement of the shutter slide 4. In a well-known manner, the handle piece 6 also comprises a grip element 6*a* for holding the pistol.

In the example shown, the firearm 7 involves a self-loading pistol with a shutter slide 4. In other examples, the firearm involves a long weapon, especially a gun with an automatic or semi-automatic reloading mechanism, in which a first magnet and a second magnet are arranged at a locking element that moves in response to a fired shot in relation to the so-called weapon housing, especially the gun stock.

The weapon housing of a long weapon corresponds to the depicted handle piece 6 of the short weapon here configured as a pistol.

In the examples shown, the first magnet 2 and the second magnet 3 are rod magnets.

The shutter slide 4 is configured to move along a track. The track extends along the firearm in a forward or backward direction. For this purpose, the shutter slide 4 is guided in a well-known manner at the handle piece 6. The track is respectively restricted by a front stop and a rear stop.

Figure 2:
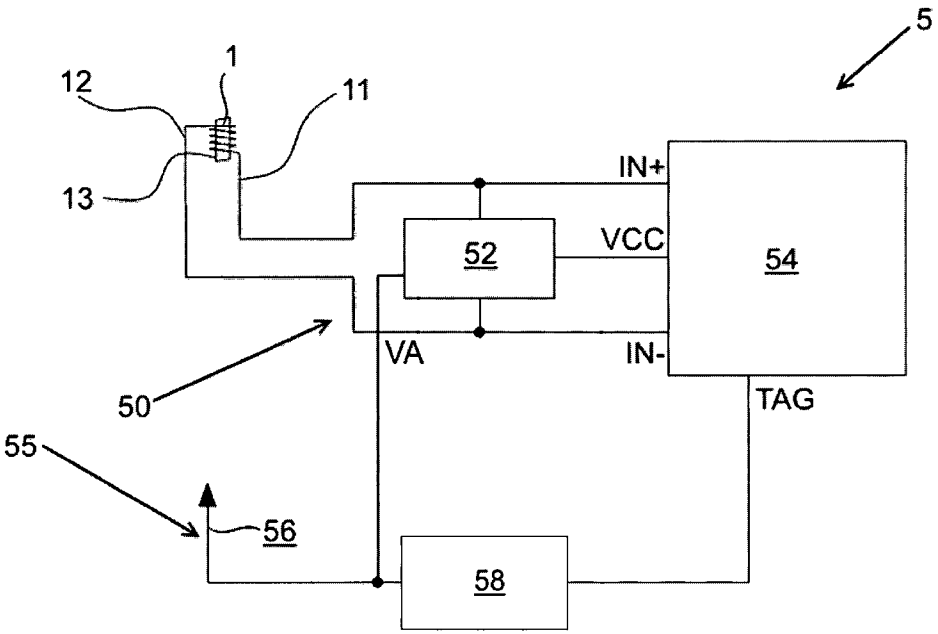
FIG. 2 shows a block diagram of an example of the shot counter disclosed herein.

FIG. 2 shows an example of a block diagram of the coil 1 and the electronic circuit 5 of the shot counter. The coil 1 comprises a first connection 11, a second connection 12, and a coil core 13. The electronic circuit 5 comprises a counting part 50, a processor 54, and a communication part 55. The counting part 50 has a power supply 52. In the example shown, the coil core 13 is rod-shaped and constructed from a soft magnetic material, for example, a soft iron core.

If a magnetic field changes in the coil 1, the first connection 11 and the second connection 12 have a potential difference, which can be measured as an induced voltage. The temporal course of the induced voltage at the first connection 11 and the second connection 12 produces an electric signal. The first connection 11 and the second connection 12 are respectively connected with the power supply 52 of the counting part 50 and with the processor 54. The processor 54 comprises a first signal input IN+, a second signal input IN+, a communication port TAG, and a supply voltage connection VCC. The power supply 52 is configured to draw an electric power from a signal, which is connected to the first and second connection 11, 12, and to provide the corresponding voltage to the processor 54 at the supply voltage connection VCC. The processor 54 is configured to receive the power from the power supply 52 and use it for processing signals supplied to the processor. Furthermore, the processor 54 is configured to receive signals from the first and second connection 11, 12, to determine whether the respectively received signal was caused by a shot, and if the signal was caused by a shot, to increment a shooting score in the processor 54. In particular, the processor is configured to recognize shot sequences. To recognize shot sequences means to determine whether shots were fired individually, in short series, or in long series. In this context, short series involve series of between two and five shots, while long series involve six or more shots in a row. The processor 54 is especially configured to receive the signal from the first and second connection 11, 12 at the first signal input IN+ or the second signal input IN+.

In some examples, in addition to a number of shots, individual input data, such as serial number, etc. can be stored in and retrieved from the processor 54.

The communication part 55 comprises an antenna and a transmit and receive circuit 58. The antenna 56 is configured to transmit and receive radio signals for the communication part 55. In particular, the antenna 56 is configured to transmit the power of the radio signals supplied from the outside via an antenna power connection VA, and to transmit the power supply 52 for operating the processor. The processor 54 is configured to process based on performance a data reception, data processing, and data output, which is provided from the outside through the power supply 52 via the antenna.

The transmit and receive circuit 58 comprises an antenna resonant circuit and is configured to adapt to the signals transmitted from the outside to the processor 54.

Furthermore, the processor 54 is configured to exchange signals via its communication port TAG with the communication part 55 and thus output and receive data via the communication part 55; especially data on fired shots. The data on fired shots comprise the number of the shots recorded by the processor, especially shot sequences. In particular, the processor 54 is also configured to receive a send command via the communication part 55 and to output data on fired shots and shot sequences in response to the send command.

In some examples, the power supply 52 ensures that the signal evaluation is not activated for slow shutter movements with low voltage peaks and strengths, as for example, when loading manually and when generally moving the shutter by hand.

In some examples, the processor 54 is configured to separate and record signals. When separating, the processor separates the signals for further processing at the first counting input IN+ and at the second counting input IN−. The processor 54 divides the electric signal into sections, each of which is to be assigned with a single occurrence. For example, a single occurrence involves a shot or a forward movement of the shutter slide. When recording the signal, the processor 54 distinguishes whether the signal was caused by a shot. If the signal was caused by a shot, the processor 54 increments a shooting score and stores the score in a volatile internal memory. In some examples, the processor 54 records shot sequences and stores the shot sequences.

In some examples, the processor 54 is configured to transmit and receive via the antenna an RFID signal. RFID stands for "radio frequency identification" which means as much as "identification with the aid of electromagnetic waves".

FIG. 3A to 3D show a quantitative representation of a connection between a movement of the shutter slide 4 when moving backwards and a voltage curve between the first coil connection 11 and the second coil connection 12, in which especially the greatest voltage spikes with their direction, sequence, and amplitude are shown and smaller voltage changes, as well as the form of the voltage curve are not considered. In FIG. 3A to 3D, the coil 1 has a coil core 13 with three prongs 13*a*, 13*b*, 13*c*, wherein the windings of the coil are arranged on a median prong 13*b*. The backward movement corresponds to a shutter opening cycle. The shutter return shown in FIG. 3A to 3D is caused by a shot with the firearm 7. In some examples, the shutter slide is moved backward because of the recoil effect, resulting from a fired shot. In other examples, the shutter slide 4 is moved backwards by a piston, which is pushed back by combustion gases caused by the shot.

The first magnet 2 comprises a north pole 2*a* and a south pole 2*b*. The second magnet 3 also comprises a north pole 3*a* and a south pole 3*b*. The first magnet 2 and the second magnet 3 are arranged at the shutter slide 4 in such a way that in a translational movement a first one of the two magnets 2, 3 passes the coil 1, and then the other magnet 2, 3 passes the coil 1. The magnets 2, 3 are arranged at the shutter slide 4 in such a way that opposite poles pass the coil 1 closer, for example, when the first magnet 2 passes the coil 1 in such a way that its south pole 2*b* passes the coil 1 closer than its north pole 2*a*, then the north pole 3*a* of the second magnet 3 passes the coil 1 closer than the south pole 3*b* of the second magnet 3. In the example shown, in a backward movement, the second magnet passes the coil first, and then the first magnet passes the coil.

Figure 3A:
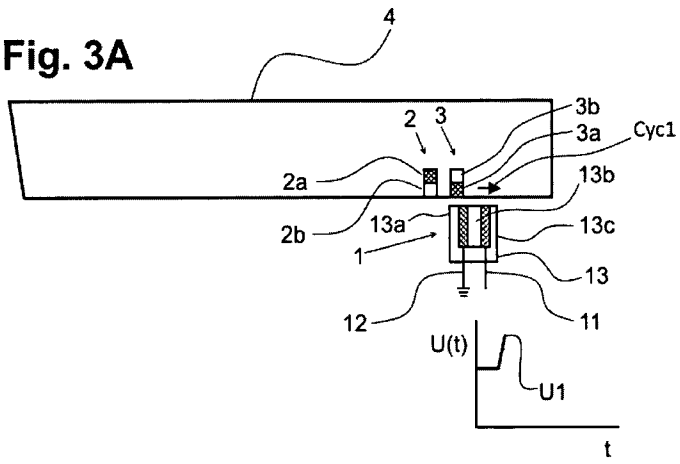
FIGS. 3A to 3D show an induction coil and a shutter slide, which has a first and a second magnet, of an example shot counter from the left, as well as a voltage curve at the induction coil resulting from a backward movement of the shutter slide.

FIG. 3A shows a return or opening cycle of the shutter slide 4, i.e., a backward movement of the shutter slide 4, wherein in the picture the north pole 3*a* of the second magnet 3 passes a front prong 13*a* of the coil core 13.

When the coil core 13 of the core 1 is for an extended period outside of the region of a magnet 2, 3, the coil core 13 is essentially magnetically neutral. This means that the "elementary magnets" in the coil core 13 stand diffuse and there is no preferred overall polarization direction. When at a return the north pole 3*a* of the second magnet 3 approaches the coil core 13, the until then neutral coil core 13 is magnetized. This means that the respective south poles of the "elementary magnets" in the coil core 3 are adjusted to the north pole 3*a* of the second magnet 3. The magnetization corresponds to a change in the magnetic field of the coil core 13. The change in the magnetic field of the coil core 13 induces an electric voltage U(t) in the coil 1, which changes over time t, and which can be picked up between the first coil connection 11 and second coil connection 12. The voltage curve shows a first voltage spike U1.

Voltage spikes indicate only the extreme values of an increasing and decreasing voltage curve.

Figure 3B:
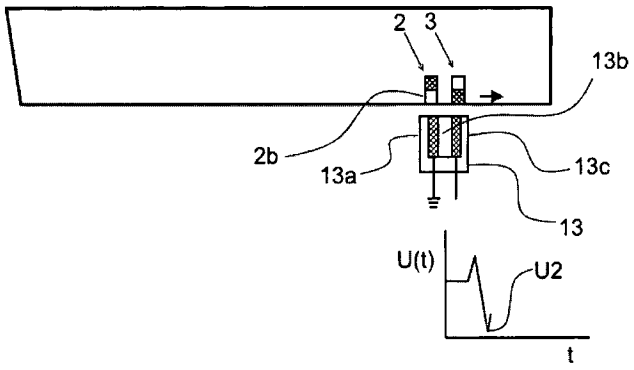

At the point in time shown in FIG. 3B, the second magnet 3 passes the rear prongs 13*c* and the median prongs 13*b* of the coil core 13. The south pole 2*b* of the second magnet 2 has passed the front prong 13*a* of the coil core 13 and begins to pass the median coil core 13*b*. By changing the pole located opposite of the coil core 13 from the north pole 3*a* of the second magnet to the south pole 2*b* of the first magnet 2, the elementary magnets, which were until then adjusted by the north pole 3*a* of the second magnet 3 are essentially reversed. This means that the respective north poles of the "elementary magnets" in the coil core 13 are adjusted to the south pole 2*b* of the first magnet 2. Reversing the polarity corresponds to a considerable change of the magnetic field in the coil core 13 within a short period of time. The considerable change of the magnetic field within a short period of time results in a second considerable voltage spike U2 opposite to the first voltage spike U1. Such reversal of the polarity of the "elementary magnets" corresponds to a greater change of the magnetic field than an initial adjustment of diffuse standing "elementary magnets". Therefore, the second voltage spike U2 has a considerably greater amplitude than the first voltage spike U1.

Figure 3C:
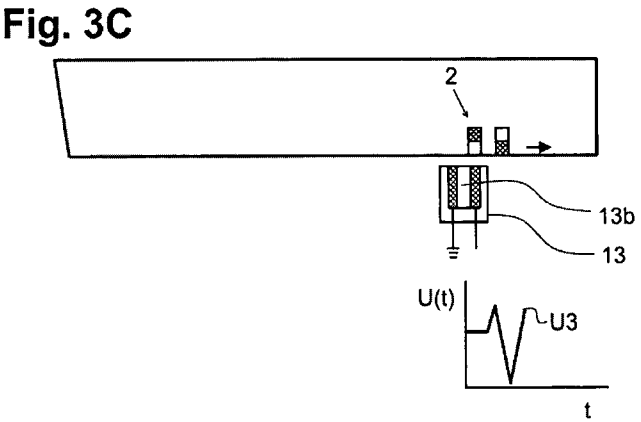
Figure 3D:
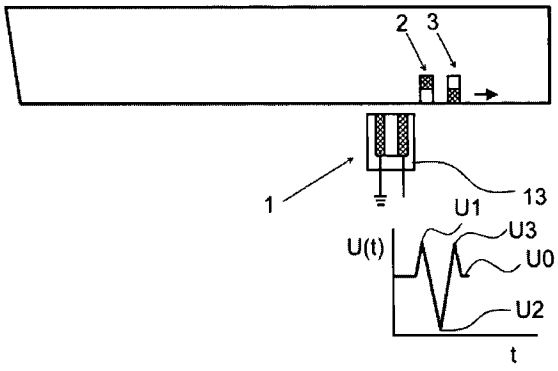

In FIG. 3C, the first magnet has essentially passed the median prong 13*b*, whereby the re-magnetization of the "elementary magnets" in the coil core is essentially concluded. The voltage curve resulting from the re-magnetization is reduced. Because the first magnet 2 has essentially passed the coil core 13, a magnetic effect of the first magnet 2 in the coil core 13 is also reduced. As a result, a magnetic field in the coil core 13 becomes weaker. The weakening is a further change of the magnetic field and results in a third voltage spike U3 opposite of the second voltage spike U2.

FIG. 3 shows the complete voltage curve U(t), as well as the first and second magnet 2, 3, which have essentially completely passed the coil 1 and the coil core 13 in the shutter opening cycle. In the example shown, the voltage curve U(t) has a positive first voltage spike U1, which is caused by the entry of the second magnet 3 into the region of the coil core 13. Then, the voltage curve U(t) has a negative second voltage spike U2, which is caused by the re-magnetization of the "elementary magnets" in the coil core 13, and which has a considerably greater amplitude than the first voltage spike U1 and finally has a positive third voltage spike U3, which is caused by the exit of the first magnet 2 and the second magnet 3 from the region of the coil core 13 and the coil 1. In the end, the voltage between the first coil connection 11 and the second coil connection 12 has assumed a permanent voltage value U0, which corresponds approximately to the value that the voltage had before starting the movement. The permanent voltage value U0 will continue until, through a new movement of the shutter slide 4, a change of the magnetic field in the coil core occurs.

In further examples, in which the coil is picked up in opposite direction or orientations of the first magnet 2 and the second magnet 3 are opposite in relation to the directions of the north and south poles, can result in a voltage curve with opposite signs. At the same time, a positive voltage spike or a negative voltage spike involves a voltage spike, the value of which exceeds or falls below the voltage between the first coil connection 11 and the second coil connection 12 in the case of a shutter slide that is not moved in relation to the coil 1.

FIG. 4A to 4D show a qualitative depiction of a connection between a forward movement of the shutter slide 4 and a voltage curve U(t) between the two coil connections 11 and 12, in which especially the greatest voltage spikes with their direction, sequence, and amplitude are shown and smaller voltage changes, as well as the form of the voltage curve are not considered. The forward movement corresponds to a shutter closing cycle in which the shutter returns forward, which is usually caused by a locking spring. For example, the shutter closing cycle follows the shutter opening cycle after a shot or when the shutter slide 4 was locked in a rear position and loosened from the catch.

FIG. 4 shows the shutter slide 4 in shutter closing cycle, wherein both magnets 2 and 3 again approach the coil 1. The first magnet 2 is already in the region of the coil 1, so that a magnetic field in the coil core 13 is changed. The change of the magnetic field in the coil core 13 induces a voltage, which can be picked up between the first coil connection 11 and the second coil connection 12, and which is shown in the diagram on the voltage curve U(t) as fourth voltage spike U4.

Before the first magnet 2 is in the region of the coil 1, the coil core 13 is re-magnetized, wherein the "elementary magnets" of the coil core 13 are diffuse polarized. In this case, a change of the magnetic field is smaller than in the following step, so that the fourth voltage spike U4 is smaller than that of the voltage spike U5 described below.

Figure 4A:
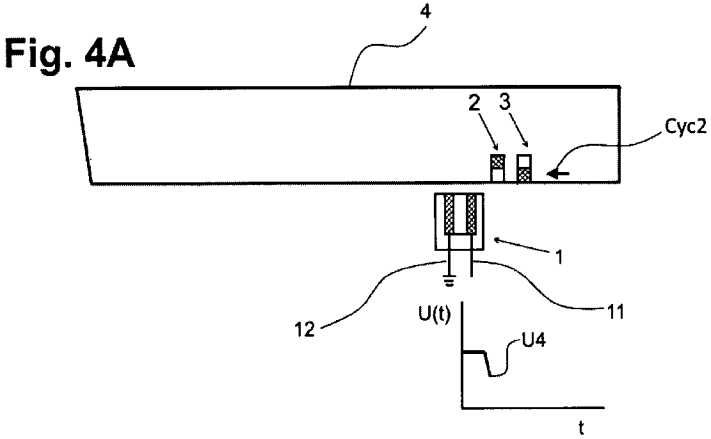
FIGS. 4A to 4D show an induction coil and a shutter slide, which has a first and a second magnet, of an example shot counter from the left, as well as a voltage curve at the induction coil resulting from a forward movement of the shutter slide.
Figure 4B:
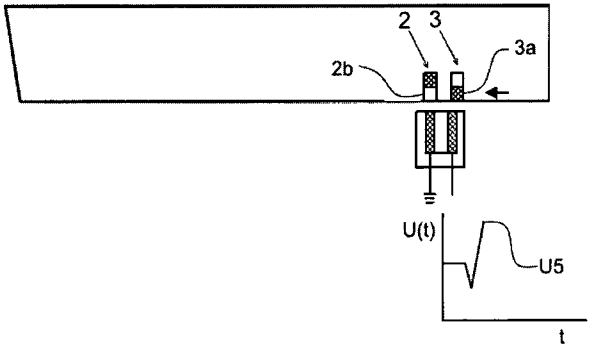

FIG. 4B shows the voltage curve of the voltage between the first coil connection 11 and the second coil connection 12, when the first magnet 2 has passed the median prong 13*b* of the coil core, and the second magnet 3 begins to pass the median coil core 13*b*. By changing the pole located opposite of the coil core 13 from the south pole 2*b* of the first magnet to the north pole 3*a* of the second magnet 3, the elementary magnets, which were until then adjusted by the south pole 2*b* of the first magnet 2 are essentially reversed. This means that the respective south poles of the "elementary magnets" in the coil core 13 are adjusted to the north pole 3*a* of the second magnet 3. Reversing the polarity corresponds to a considerable change of the magnetic field in the coil core 13 within a short period of time. The considerable change of the magnetic field within a short period of time results in a fifth voltage spike U5 opposite to the first voltage spike U1. Such reversal of the polarity of the elementary magnets corresponds to a greater change of the magnetic field than an initial adjustment of diffuse standing elementary magnets or magnetization through the first magnet 2 of the elementary magnets, which were already polarized according to the first magnet. Therefore, the fifth voltage spike U5 has a considerably greater amplitude than the fourth voltage spike U4.

Figure 4C:
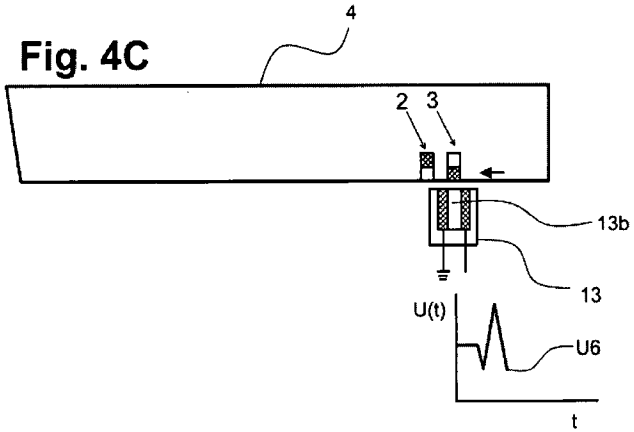

FIG. 4C shows a shutter slide 4, which is moved so far forward that the first magnet 2 leaves the region of the coil core 13 while the second magnet 3 is approximately located above the median prong 13*b* of the coil core 13. The change of the magnetic field in the coil core 13 resulting from the approach of the second magnet 3 is concluded, thus reducing the voltage spike. After the second magnet 3 leaves the region of the median prong 13*b* of the coil core 13, the magnetic field in the coil core is again reduced. Thus, the reduction causes a sixth voltage spike U6 in opposite direction of the fifth voltage spike U5. The sixth voltage spike U6 is considerably smaller than the fifth voltage spike U5.

Figure 4D:
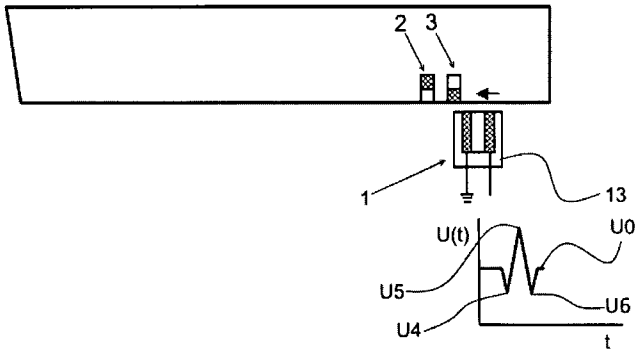

FIG. 4D shows a complete voltage curve U(t), as well as the first and second magnets 2, 3, which have essentially completely passed the coil 1 and the coil core 13 in the shutter lead. A change of the magnetic field in the coil core 13 is essentially concluded. The voltage between the first coil connection 11 and the second coil connection 12 has assumed the permanent voltage value U0, which corresponds approximately to the value that the voltage had before starting the movement. The permanent voltage value U0 will continue until through a new movement of the shutter slide 4 a change of the magnetic field in the coil core occurs.

A distinction of the voltage curve between a shutter opening cycle, such as the one shown in FIG. 3A to 3D, and a voltage curve resulting from a shutter closing cycle, such as the one shown in FIG. 4A to 4D, is made possible especially through two characteristics of the different voltage curve signals:

Initially, the voltage curve signal in forward direction is polarized in reverse in relation to the voltage curve signal in reverse direction, because the poles of the first and second magnet 2, 3 sweep over the coil core 13 in respectively opposite direction. As a result, the second voltage spike U2, which has a considerably greater amplitude than the first and the third voltage spike U1, U3 of the shutter return or opening cycle, is opposed to the fifth voltage spike U5, which has a considerably greater amplitude than the fourth and the sixth voltage spike U4, U6 of the shutter closing cycle. Therefore, a voltage signal for a shutter opening cycle can be clearly distinguished from a voltage signal for a shutter closing cycle by means of a clear characteristic. Furthermore, if the voltage signal is caused by a shot, the shutter closing cycle of the shutter slide 4 is performed at a considerably higher speed than the shutter closing cycle of the shutter slide 4. This results in a considerably higher amplitude of the voltage curve for a shutter opening cycle. Based on the height of the voltage curve for a shutter opening cycle, the processor 54 can distinguish a shot from a different occurrence of the shutter opening cycle, for example, manual loading by a shooter. In some examples, when firing a shot, the shutter opening cycle is at least twice as fast as the shutter closing cycle. In some examples, the shutter opening cycle is performed at a speed of app. 7 m/s and the shutter closing cycle is at a speed of app. 2.0 m/s.

In some examples, the distance of the first and second magnet is the same or greater than the distance of the front prong 13*a* to the median prong 13*b* and the distance of the median prong 13*b* to the rear prong 13*c*. In further examples, the distance of the front edge of the first magnet 2 to the rear edge of the second magnet 3 is not greater than the distance of the front prong 13*a* to the rear prong 13*c*. This ensures that the coil core 13 undergoes the polarity reversal within the shortest period of time possible, so that the second and the fifth voltage spike are as high as possible. In some examples, the distances of the prongs 13*a*, 13*b*, 13*c* and the distance of the first and second magnet 2, 3 are dimensioned in such a way that a speed of the shutter opening cycle when firing a shot results in a maximum amplitude of the second voltage spike U2.

Figure 5:
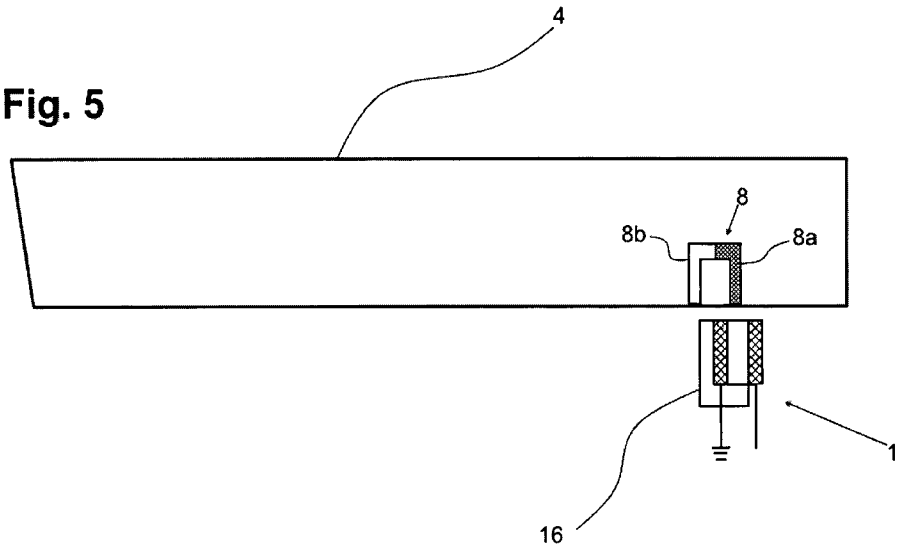
FIG. 5 shows a further example of a shutter slide and a coil.

FIG. 5 shows a further example of the shutter slide 4 and the coil 1. In this example, only a single magnet 8 is provided, which is preferably configured in the form of a horseshoe magnet. At the same time, the single magnet 8 is arranged in such a way that its north pole 8*a* points in the direction of a shutter slide return in front of the south pole 8*b*—or vise versa. The poles 8*a*, 8*b* of the single magnet are oriented in such a way that they pass the coil core one after the other when the shutter slide 4 moves along the track, which extends along the firearm in forward direction and backward direction. For a region passing the coil 1, the magnetic field lines of the single magnets in this orientation correspond essentially to the magnetic field lines of the arrangements of the first and second magnet 2, 3, as shown above. Therefore, the arrangement of the single magnet 8 is basically suitable of providing a similar function as the arrangement of the first and second magnet 2, 3. For example, the north pole 8*a* of the single magnet 8 is arranged in place of the north pole 3*a* of the second magnet 3, and the south pole 8*b* of the single magnet first magnet is arranged in place of the south pole 2*b* of the first magnet 2.

In the example shown, the coil core 16 is U-shaped. In some examples, a U-shaped coil core is used to simplify the shot counter. In other examples, a three-prong coil core 13 is Used, because the coil 1 with a three-prong coil core 13 of the electronic circuit 5 and the processor supplies more power and clearer signals.

Figure 6A:
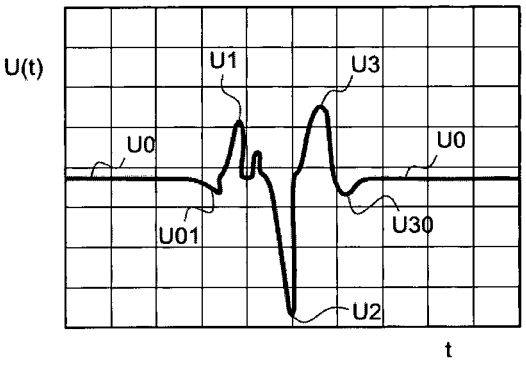
FIG. 6A shows a complete voltage signal at the induction coil due to backward movement of the shutter slide, which is triggered by a shot.
Figure 6B:
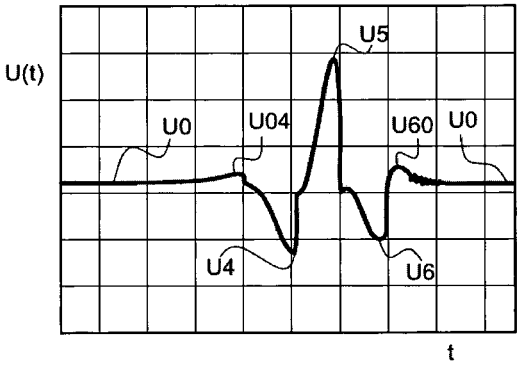
FIG. 6B shows a voltage curve at the induction coil due to forward movement of the shutter slide.
Figure 6C:
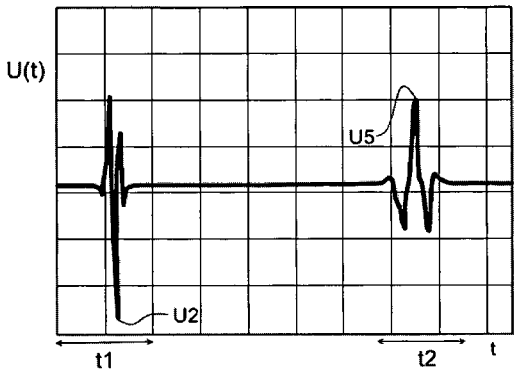
FIG. 6C shows a voltage curve having a complete signal at the induction coil when shooting with a shutter return signal and a shutter lead signal.

FIG. 6A to 6C show actual voltage curves U(t) measured with the help of an oscilloscope.

FIG. 6A is a depiction of the voltage curve U(t) of the voltage between the first coil connection 11 and the second coil connection 12 over a time t in a shutter return caused by firing a shot. Before the first or second magnet 2, 3 enters the region of the coil 1, the voltage has reached a permanent voltage value U0. The entry of the second magnet 3 into the region of the median prong 13*b* of the coil core 13 initially results in the first voltage spike U1, because of the changing magnetic field at the median prong 13*b*. The entry of the first magnet 2 into the region of the median prong 13*b* of the coil core 13 results in the second voltage spike U2, which represents a voltage curve that is opposite to the first voltage spike U1. Due to the polarity reversal of the coil core 13 described above, the amplitude of the second voltage spike U2 is considerably greater than the amplitude of the opposite first voltage spike U1. In one example, the amplitude of the second voltage spike U2 is at least one and a half times as great as the amplitude of the first voltage spike U1.

In response to the second voltage spike U2, the processor 54 increments a shooting score and stores the score.

When the first magnet 2 leaves the region of the median prong 13*b* of the coil core 13, the magnetic field in the median prong 13*b* is reduced. This reduction causes the third voltage spike U3. However, since the reduction is no longer associated with a polarity reversal, the amplitude of the third voltage spike U3 is considerably smaller than the amplitude of the second voltage spike U2. In one example, the amplitude of the second voltage spike U2 is at least one and a half times as great as the amplitude of the third voltage spike U3.

After the third voltage spike U3, the voltage returns to the permanent voltage value U0. In addition, the voltage curve U(t) shows smaller voltage spikes U01, U30. The first smaller voltage spike U01 is formed before the first voltage spike U1, when the second magnet 3 passes the front prong 13*a*, which does not carry a coil winding. The second smaller voltage spike U30 is formed after the third voltage spike U3, when the first magnet 2 passes the rear prong 13*c*, which does not carry a coil winding.

FIG. 6B is a depiction of the voltage curve U(t) of the voltage between the first coil connection 11 and the second coil connection 12 over a time t in a lead of the shutter slide 4. Before the first or second magnet 2, 3 enters the region of the coil 1, the voltage has reached a permanent voltage value U0. The entry of the first magnet 2 into the region of the median prong 13*b* of the coil core 13 initially results in the fourth voltage spike U4, because of the changing magnetic field at the median prong 13*b*. The entry of the second magnet 3 into the region of the median prong 13*b* of the coil core 13 results in the fifth voltage spike U5, which represents a voltage curve that is opposite to the fourth voltage spike U4. Due to the polarity reversal of the coil core 13 described above, the amplitude of the fifth voltage spike U5 is considerably greater than the amplitude of the opposite fourth voltage spike U4. When the second magnet 3 leaves the region of the median prong 13*b* of the coil core 13, the magnetic field in the median prong 13*b* is reduced. The reduction causes the sixth voltage spike U6. However, since the reduction is no longer associated with a polarity reversal, the amplitude of the sixth voltage spike U6 is considerably smaller than the amplitude of the fifth voltage spike U5.

After the sixth voltage spike U6, the voltage returns to the permanent voltage value U0. In addition, the voltage curve U(t) shows smaller voltage spikes U04, U60. The first smaller voltage spike U04 is formed before the fourth voltage spike U4, when the first magnet 2 passes the rear prong 13*c*, which does not carry a coil winding. The fourth smaller voltage spike U60 is formed after the sixth voltage spike U6, when the second magnet 3 passes the front prong 13*a*, which does not carry a coil winding.

FIG. 6C shows a voltage curve U(t) of he voltage between the first coil connection 11 and the second coil connection 12 in a shot cycle with a shutter return caused by a shot, and a lead of the shutter slide 4 caused by the locking spring. At the same time, the signal for the shutter return ranges in a first period of time t1, and the signal for the shutter lead ranges in a second, later period of time t2. Both periods of time have a respective voltage spike U2, U5, the amplitude of which is considerably greater than the remaining, respectively preceding voltage spikes in the respective period of time t1, t2. The voltage spikes in the first and second period of time differ in that in the first period of time t1 the second voltage spike U2 is negative and the fifth voltage spike U5 in the second period of time t2 is positive. Furthermore, the amplitude of the second voltage spike U2 is considerably greater than the amplitude of the fifth voltage spike U5. In one example, the amplitude of the second voltage spike U2 amounts to at least one and a half time the amplitude of the fifth voltage spike U5. The greater amplitude of the second voltage pike U2 is caused by a higher speed, with which the shutter slide 4 glides backwards when a shot is fired. The higher speed of the shutter slide 4 causes a faster change of a magnetic field in the coil core 13. The quicker change of the magnetic field in the coil core 13 causes a higher induced voltage between the first coil connection 11 and the second coil connection 12. The higher induced voltage is also suitable to differentiate a fired shot from manual reloading, because in a manual reloading process, the shutter glides much slower backwards than when a shot is fired.

Further obvious configurations of the invention can be seen by an expert in the context of the following claims.

The invention claimed is:

1. An apparatus for recording a number of shots fired by a firearm, wherein the apparatus comprises:

a first magnetic pole;

a second magnetic pole; and a coil;

wherein the first and the second magnetic poles are arranged in such a way that they move, in response to a shot, relative to the coil, with polarizations opposite to each other, which pass the coil one after the other such that they induce opposite voltages in the coil one after the other during a forward movement and a backward movement, respectively.

2. An apparatus according to claim 1, in which the firearm includes a self-loading firearm.

3. An apparatus according to claim 1, wherein the coil includes a coil core.

4. An apparatus according to claim 3, wherein the coil core is constructed from a soft magnetic material.

5. An apparatus according to claim 4, in which the coil core includes at least two parallel prongs, which are arranged in such a way that the first magnetic pole and the second magnetic pole pass each of the prongs one after the other.

6. An apparatus according claim 1, wherein the first and the second magnetic poles are associated with one magnet.

7. An apparatus according to claim 1, wherein the first and the second magnetic poles are arranged at a locking element, and the coil is arranged at the handle piece or at the housing of the firearm.

8. An apparatus according to claim 1, further including a processor, wherein the coil is configured to provide the processor (54) at least with a portion of the voltage induced in the coil.

9. An apparatus according to claim 8, wherein the processor is configured to identify and count a fired shot when an amplitude of the induced voltage passes a threshold level and/or a course of the induced voltage corresponds to a predetermined form.

10. An apparatus according to claim 9, wherein the processor is configured to use a portion of the induced voltage provided, to supply operating power.

11. An apparatus according to claim 10, further comprising an antenna that is configured to emit a signal that corresponds to the number of shots fired by the firearm and identified by the processor.

12. An apparatus according to claim 11, in which the antenna is configured to receive a send command, which causes the processor to emit via the antenna the signal that corresponds to the number of shots fired by the firearm.

13. An apparatus according to claim 1, wherein the first magnetic pole and the second magnetic pole are arranged at a distance to each other, so that, when the first magnetic pole and the second magnetic pole pass the coil in response to a fired shot, the amount of the induced voltage is at a maximum.

14. A firearm comprising:

a handle;

a coil disposed on the handle;

a slide movable relative to the handle;

a first magnetic pole having a first polarization disposed on the slide; and a second magnetic pole having a second polarization opposite the first polarization disposed on the slide;

wherein the first and the second magnetic poles move relative to the coil based on a firearm shot and induce in the coil opposite voltages.

15. A method for recording a number of shots fired by a firearm, wherein the method comprises:

the provision of a first magnetic pole;

the provision of a second magnetic pole, its magnetic polarization opposite to the polarization of the first magnetic pole;

the provision of a coil;

in response to a fired shot, the passing of first the second magnetic pole and subsequently the first magnetic pole at the coil, so that thereby opposite voltages are induced at the coil;

the recording of the induced voltages; and based on the form of the induced voltages, especially the amplitude, deciding whether a shot was fired, and when a shot was fired, incrementing a shooting score.

16. A method according to claim 15, in which the first magnetic pole and the second magnetic pole are provided at a locking element of the firearm, and the coil is provided at the handle piece or at the housing of the firearm.

17. A method according to claim 16, in which a return of the locking element differs from a lead by the direction of the induced voltage spikes located above or below a predetermined threshold.

18. A method according to claim 17, in which the return of the locking element differs from its lead by the form, especially the amplitude, of the induced voltage spikes in the forward and reverse direction of the locking element.

* * * * *